US005656331A

United States Patent [19]

Kline

[11] Patent Number: 5,656,331

[45] Date of Patent: Aug. 12, 1997

[54] PRINTED SUBSTRATE HAVING A METALLIC FINISH AND METHOD FOR PRODUCING SAME

[75] Inventor: Richard L. Kline, Fairlawn, N.J.

[73] Assignee: Union Camp Corporation, Princeton, N.J.

[21] Appl. No.: 394,973

[22] Filed: Feb. 27, 1995

[51] Int. Cl.[6] ..... B05D 1/36; B05D 5/04; B41F 1/18; B41F 1/10

[52] U.S. Cl. ..... 427/258; 427/265; 427/267; 101/450.1; 101/490; 428/206; 428/207

[58] Field of Search ..... 427/258, 267, 427/268, 265, 152; 101/DIG. 29, 490, 491, 450.1, 211; 428/206, 207

[56] References Cited

U.S. PATENT DOCUMENTS

| | | | |
|---|---|---|---|
| 2,104,790 | 7/1938 | Casto | 427/258 |
| 2,972,303 | 2/1961 | De Marchi et al. | 101/491 |
| 4,780,364 | 10/1988 | Wade et al. | 428/315.5 |
| 5,407,711 | 4/1995 | Lovison et al. | 427/265 |
| 5,468,540 | 11/1995 | Lu | 428/156 |
| 5,496,587 | 3/1996 | Leung | 427/258 |

*Primary Examiner*—Shrive Beck
*Assistant Examiner*—Fred J. Parker
*Attorney, Agent, or Firm*—Richard R. Muccino; Charles A. Gaglia, Jr.

[57] ABSTRACT

The present invention is directed to printed substrates having a metallic finish and methods for producing such printed substrates, preferably using an offset lithographic press. The method comprises coating a printing substrate with three coats of ink applied successively as follows: (1) a first coat comprising a solid color corresponding to the final color of the desired printing substrate; (2) a second coat comprising a moire pattern color; and (3) a third coat comprising water pearl.

15 Claims, 2 Drawing Sheets

PRINTED SUBSTRATE HAVING A METALLIC FINISH AND METHOD FOR PRODUCING SAME

FIELD OF THE INVENTION

The present invention is directed to printed substrates having a metallic finish and methods for producing such printed substrates, preferably using an offset lithographic press. The method comprises coating a printing substrate with three coats of ink applied successively as follows: (1) a first coat comprising a solid color corresponding to the final color of the desired printing substrate; (2) a second coat comprising a moire pattern color; and (3) a third coat comprising water pearl.

DESCRIPTION OF THE BACKGROUND

Printing traditionally has been defined as a technique for applying under pressure a certain quantity of coloring agent onto a specified surface to form a body of text or an illustration. A more contemporary definition of printing describes printing as any of several techniques for reproducing texts and illustrations, in black or color, on a durable surface and in a desired number of identical copies.

Printing has maintained a quasi-monopoly on the transmission or storage of information. Printing has helped give birth to radio, television, film, microfilm, tape recording, and other rival techniques. Printing is used not merely for making books and newspapers, but also for manufacturing textiles, plates, wallpaper, packaging, billboards, and miniature electronic circuits.

Printing processes require a combination of four elements: (1) a printing press, (2) a printing image carrier, (3) printing ink, and (4) a printing substrate. The act of printing or making the impression takes place in the printing press. The printing image contained in the printing image carrier or printing plate is transferred during this act by means of the printing ink to the paper. In this process, the printing image becomes the printed image. All contemporary industrial printing requires a combination of these four elements.

Gravure printing is an example of intaglio printing. Gravure printing uses a sunken or depressed surface for the image. The image or printing areas are cells or wells etched into a copper cylinder and the non-printing areas are the unetched surface of the cylinder. The image cylinder rotates in a bath of ink. The excess ink is wiped off the surface of the image cylinder by a flexible steel doctor blade. The ink remaining in the thousands of recessed cells of the image cylinder forms the image by direct transfer to the paper as the paper passes between the image cylinder and an impression cylinder.

There are three types of gravure printing: conventional gravure, variable area-variable depth gravure, and direct transfer or variable area gravure. Conventional gravure is used for shorter run, high-quality illustration printing. Variable area-variable depth gravure cylinders made by halftone gravure are used for newspaper supplement, magazine, and catalog printing. Variable area gravure is used mainly for packaging printing.

Gravure presses are manufactured to print sheets (sheetfed gravure) or rolls (rotogravure) of paper. Most gravure is printed from rolls. Sunday newspaper magazine sections or supplements, color inserts for newspapers, large mail order catalogs, wallpaper, plastic laminates, and postage stamps are examples of rotogravure printing.

Gravure printing is considered to be excellent for reproducing pictures and providing metallic finishes, but the high cost of making the image cylinder usually limits the use of gravure to long runs. Accordingly, printing methods which can provide the quality of gravure printing but do so less expensively are very desirable.

The most popular, and a more economical, printing process is lithography. Lithography uses the planographic method. In lithography, the printing area and non-printing area are essentially on the same plane of a thin metal plate and the distinction between the areas is maintained chemically. There are two basic differences between offset lithography and other printing processes: (1) offset lithography is based on the principle that grease and water do not mix, and (2) ink is offset first from the printing plate to a rubber blanket, and then from the rubber blanket to a printing substrate.

When a lithographic printing plate is made, the printing area is made grease-receptive and water-repellent (hydrophobic), and the non-printing area is made water, receptive and ink-repellent (hydrophilic). The printing plate is mounted on a plate cylinder of a press which, as it rotates, comes into contact successively with rollers wet by water and rollers wet by ink. The water wets the non-printing area of the printing plate and prevents ink from wetting this area. The ink then wets the printing area and this wet printing area or image is then transferred from the printing plate to an intermediate rubber blanket cylinder. The wet or inked image is then transferred to a printing substrate as the substrate is passed between the blanket cylinder and an impression cylinder.

Transferring a printing image from a printing plate to a rubber blanket before transferring the image to a printing substrate is called the offset principle. Letter press printing and gravure printing can also employ this offset principle but because most lithography is printed in this way, the term offset has become synonymous with lithography. One major advantage of the offset principle is that the soft rubber surface of the blanket creates a clear impression on a wide variety of paper surfaces and other materials with both rough and smooth textures with a minimum of press make-ready. Offset printing can be recognized by a smooth print, as well as by the lack of any impression, ring of ink, or serrated edge which are characteristic of letterpress printing and gravure printing.

Lithographic offset presses are generally described in terms of the number of colors they can print, whether they are sheet or roll fed, and whether or not they are perfecting.

The number of colors a press can print refers to the number of printing units. Each printing unit will be run with a different color and the number of colors describes how many separate colors can be printed on the sheet with one pass through the press. A split ink fountain on one or more of the units results in more colors being layed down during one pass through the press. The design of multi-color presses has followed two basic approaches. As the lithographic process grew, multi-color presses developed primarily by assembling single color units in tandem with transfer devices between units. Two such units are set up in tandem with a transfer device between them to become a four color press. Three such units become a six color press. The range of colors on most presses used for the general run of lithographic work is from single color to six colors. In the metal decorating field there are presses which "roller-coat" lacquer or base tint on the metal blank before it is passed into the first printing unit.

Whether a press is sheet fed or roll fed designates whether the press moves cut sheets through the feeder or is fed by threading a web of paper from a roll through the press. Web press or roll-fed are the common terms for a press which prints on paper fit directly from a roll. Sheetfed presses which utilize a roll sheeter in place of, or to supplement, a sheet feeder are described as roll-fed through a sheeter.

A perfecting press is a press which prints on both sides of the paper in one pass. Perfecting presses may be sheetfed or roll-fed, single-color or multicolor. Most web-fed presses are perfecting multicolor presses of the blanket-to-blanket design. However, if equipped with the necessary white-roll stands, these presses can be used as single-color perfecting.

Sheetfed lithography is used for printing advertising, books, catalogs, greeting cards, posters, labels, packaging, folding boxes, coupons, trading stamps, and art reproductions. Web offset is used for printing business forms, newspapers, preprinted newspaper inserts, advertising literature, catalogs, long-run books, encyclopedias, and magazines.

SUMMARY OF THE INVENTION

Figure 1A:
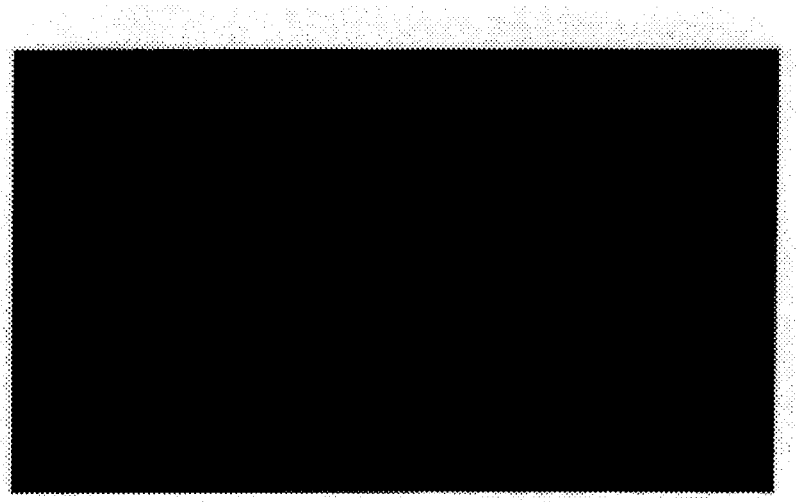
FIG. 1 is a photograph of three coats of ink applied successively to a printing substrate. Panel A shows a first coat comprising a gray solid color corresponding to the final color of the desired printing substrate. Panel B shows a second coat comprising a gray moire pattern color. Panel C shows a third coat comprising water pearl.

The present invention is directed to a method for producing a metallic finish on a printing substrate which comprises the steps of coating the printing substrate with three coats of ink applied successively as follows to produce a metallic finish on the printing substrate:

(1) a first coat comprising a solid color corresponding to the final color of the desired printing substrate;

(2) a second coat comprising a moire pattern color; and (3) a third coat comprising water pearl.

In another embodiment, the invention is directed to a printed substrate having a metallic finish comprising a first coat, a second coat, and a third coat of ink wherein the first coat on the printed substrate comprises a solid color corresponding to the final color of the printed substrate, the second coat, which is over the first coat, comprises a moire pattern color, and the third coat, which is over the second coat, comprises water pearl.

In still another embodiment, the invention is directed to a method for producing a metallic finish on a printing substrate using an offset lithographic press which comprises the steps of:

(a) providing an offset lithographic press having a printing plate with a hydrophilic printing area and a hydrophilic non-printing area, a plate cylinder on which the printing plate is mounted, hydrophilic dampening rollers, hydrophilic ink rollers, a blanket cylinder, and an impression cylinder;

(b) rotating the plate cylinder so that the cylinder first comes into contact with the hydrophilic dampening rollers permitting water from the hydrophilic dampening rollers to wet the hydrophilic non-printing area of the printing plate and preventing ink from the hydrophobic ink rollers to wet the hydrophilic non-printing area;

(c) rotating the plate cylinder so that the cylinder second comes into contact with the hydrophobic ink rollers permitting ink from the hydrophobic ink rollers to wet the hydrophobic printing area of the printing plate;

(d) transferring the wet hydrophobic printing area from the printing plate to the blanket cylinder; and (e) passing a printing substrate between the blanket cylinder and the impression cylinder to transfer the wet hydrophobic printing area from the blanket cylinder to the printing substrate;

wherein the printing substrate is coated with three coats of ink applied successively as follows to produce a metallic finish on the printing substrate:

(1) a first coat comprising a solid color corresponding to the final color of the desired printing substrate;

(2) a second coat comprising a moire pattern color; and (3) a third coat comprising water pearl.

In yet another embodiment, the invention is directed to a printed substrate having a metallic finish prepared by a method using an offset lithographic press which comprises the steps of:

(a) providing an offset lithographic press having a printing plate with a hydrophobic printing area and a hydrophilic non-printing area, a plate cylinder on which the printing plate is mounted, hydrophilic dampening rollers, hydrophobic ink rollers, a blanket cylinder, and an impression cylinder;

(b) rotating the plate cylinder so that the cylinder first comes into contact with the hydrophilic dampening rollers permitting water from the hydrophilic dampening rollers to wet the hydrophilic non-printing area of the printing plate and preventing ink from the hydrophobic ink rollers to wet the hydrophilic non-printing area;

(c) rotating the plate cylinder so that the cylinder second comes into contact with the hydrophobic ink rollers permitting ink from the hydrophobic ink rollers to wet the hydrophobic printing area of the printing plate;

(d) transferring the wet hydrophobic printing area from the printing plate to the blanket cylinder; and (e) passing a printing substrate between the blanket cylinder and the impression cylinder to transfer the wet hydrophobic printing area from the blanket cylinder to the printing substrate;

wherein the printing substrate is coated with three coats of ink applied successively as follows to produce a metallic finish on the printing substrate:

(1) a first coat comprising a solid color corresponding to the final color of the desired printing substrate;

(2) a second coat comprising a moire pattern color; and (3) a third coat comprising water pearl.

DETAILED DESCRIPTION OF THE INVENTION

Applicant has discovered a method for producing a metallic finish on a printing substrate, preferably using an offset lithographic press. The novel method comprises the steps of (a) providing an offset lithographic press having a printing plate with a hydrophobic printing area and a hydrophilic non-printing area, a plate cylinder on which the printing plate is mounted, hydrophilic dampening rollers, hydrophobic ink rollers, a blanket cylinder, and an impression cylinder; (b) rotating the plate cylinder so that the cylinder first comes into contact with the hydrophilic dampening rollers permitting water from the hydrophilic dampening rollers to wet the hydrophilic non-printing area of the printing plate and preventing ink from the hydrophobic ink rollers to wet the hydrophilic non-printing area; (c) rotating the plate cylinder so that the cylinder second comes into contact with the hydrophobic ink rollers permitting ink from the hydrophobic ink rollers to wet the hydrophobic printing area of the printing plate; (d) transferring the wet hydrophobic printing area from the printing plate to the blanket cylinder; and (e) passing a printing substrate between the blanket cylinder and the impression cylinder to transfer the wet hydrophobic printing area from the blanket cylinder to the printing substrate. The printing substrate is coated with three coats of ink applied successively as follows to produce a metallic finish on the printing substrate: (1) comprising a solid color corresponding to the final color of the desired printing substrate; (2) a second coat comprising a moire pattern color; and (3) a third coat comprising water pearl. The present invention provides a metallic finish on a printing substrate which is more economical than metallic finishes provided by gravure printing because the high cost of making the gravure image cylinder is avoided. The metallic finish may be in any color desired.

As set out above, a printing substrate may be coated with three coats of ink in accord with the method of the present invention to produce a metallic finish on the printing substrate. The printing substrate may be coated using any printing press desired, preferably the printing substrate is coated using an offset lithographic press. The three coats of ink may be applied in one pass through a multi-color press or may be applied in three passes through a single color press. Preferably, the three coats of ink are applied in one pass through a multi-color press.

The first coat of ink applied to the printing substrate is a solid color corresponding, to the final color of the desired printing substrate. This first coat of ink may be any color desired, such as gray, black, red, green, blue, gold, silver, and the like, and will be the color of the final printing substrate.

The second coat of ink applied to the printing substrate is a moire pattern, or grain screen, color. The moire pattern color, over the first coat of solid color, gives the appearance of a metallic finish on the printing substrate. The moire pattern color may be in any color. Preferably, the moire pattern color is in the same color as that of the final desired printing substrate.

A moire pattern is a pattern resulting from interference beats between two sets of periodic structures in an image. A moire pattern is the geometrical design that results when a set of straight or curved lines is superimposed onto another set. The name moire is derived from a French word for "watered". A moire pattern can be observed in the following manner. If one draws a regular pattern of vertical lines of a given width and spacing on a transparent sheeted overlays this sheet onto another sheet ruled with lines of differing line widths and spacings and then moves the two ruled surfaces horizontally with relation to each other, a shimmering moire pattern will be noted. This moire pattern results because of differences in the reinforcement of the lines and spaces one over the other. The lines are in step in some locations and out of step in other locations.

The third coat of ink applied to the printing substrate is water pearl. Water pearl is a water base ink with pearl flakes. The pearl flakes may be pearl essence or pearl pigment which are nacreous pigments. Nacreous pigments are pigments containing guanine crystals obtained from fish scales or fish skin and give a pearly, lustrous effect. A nacreous pigment particle is generally a very thin platelet of high index of refraction. The crystals are readily oriented into parallel layers because of their shape. Being transparent, each crystal reflects only part of the incident light reaching it, and transmits the remainder to the crystals below. The nacreous effect is obtained from the simultaneous reflection of light from the many parallel microscopic layers.

The ratio of first, second, and third coats of ink is a matter of preference subject to such factors as the type of metallic finish desired on the printing substrate as well as the color itself and other ingredients in the composition. In a preferred embodiment, the ratio of first, second, and third coats of ink is about 1:1:1.

In accord with the present invention, applicant's lithographic method of applying three coats of specific types of ink in the specific manner set out above provides a metallic finish on a printing substrate which is more economical than metallic finishes provided by gravure printing.

The offset lithographic printing apparatus useful in accordance with the present invention are well known in the printing arts, and therefore the selection of the specific apparatus will be apparent to the artisan. Offset presses utilize three principal elements: the plate cylinder on which the printing plate is mounted; the blanket cylinder which receives the printing image from the printing plate; and the impression cylinder, which applies the paper, in sheets or on a roll, against the blanket cylinder to transfer the printing image from the blanket cylinder to the printing substrate.

The plate cylinder has a groove in which the attaching and tension mechanisms are housed. A hydrophobic moistening system and a hydrophobic inking system are connected to this cylinder. The wetting system, which dampens the plate before it is inked, consists of a series of rollers that transmit regularly controlled quantities of water taken up by puddling in a tank or sprayed from rotary brushes grazing its surface. The inking system has a series of alternating hard and soft rollers that grind, spread, and evenly distribute the ink in a uniform thickness.

The blanket cylinder also has a groove containing the mechanism for attaching and controlling the tension of the blanket, which consists of several layers of fabric and rubber. During printing the groove of the blanket cylinder and that of the plate cylinder coincide at each revolution.

On sheetfed machines, the impression cylinder has a cavity in which a system of articulated grippers is recessed. The movement of the machine is synchronized so that at each revolution the slightly projecting grippers enter into the groove in the blanket cylinder in such a way as to cause no damage to the latter. This problem does not arise on the impression cylinders of roll-fed rotaries, and their-movement does not therefore have to be synchronized with that of the other cylinders. In sheetfed presses the three cylinders, usually placed side by side, are of the same diameter and turn at the same speed. The movement of the cylinders is synchronized by meshing sprocket wheels. Paper is fed in by a feeder similar to that of letterpress presses.

In printing two or more colors during the offset process, the dampness of the plate is partly transferred, via the blanket, to the paper. This slightly alters the paper's dimensions, causing difficulties in register. The separate colors are therefore printed as simultaneously as possible.

On some two-color machines a single impression cylinder applies each sheet successively against two blanket cylinders, which receive a transfer from their own plate cylinders. More generally, sheetfed offset machines printing in two or more colors are designed as a series of printing units each consisting of three cylinders with their wetting and inking systems, the sheet being transferred from one unit to the next on drums of large diameter with a system of articulated grippers.

In the offset process an unusual arrangement, without impression cylinders, is possible. Simultaneous printing is done of both sides of the sheet as it passes between two juxtaposed blanket cylinders. Each receives a transfer from its own plate cylinder and prints one side of the sheet while at the same time acting as an impression cylinder for printing the other side of the sheet. Thus, the blanket-blanket machine consists of a total of only four cylinders. The various kinds of machines can be used in combination: for example, three one-color units and one blanket-to-blanket machine can print one side of the in four colors, the other side in black.

Roll-fed rotaries work on the same principle as sheetfed presses, with two differences. The groove for the plate fasteners on the plate cylinder is very and the impression cylinder, lacking grippers, has an entirely level surface rotaries are designed as a succession of one-color printing units or, more frequently blanket-to-blanket units. On these, as on the others, printing in colors is done by sending the paper directly and horizontally through successive units. On blanket-to-blanket rotaries, the back is printed with the front. On rotaries made up of one-color units, a turning bar the direction in which the roll of paper presents itself. Feeding the paper into and taking delivery of it from the machine can be combined so that the rolls are superimposed to form a signature.

Satellite rotaries (drum presses) work on the principle of a single impression cylinder of very large diameter that has arranged around its outer surface four, five, or sometimes six blanket cylinders. Each receives a transfer from its own individually moistened and inked plate cylinder. Thus, color printing one side of a roll of paper is accomplished in a single revolution of the impression cylinder. Drum cylinders are most often made up of two groups printing one side after the other. For quality color printing with a thickness of ink, rapid drying is necessary to prevent smudging. The therefore moves horizontally into a drier heated by a ramp of gas burners or hot-air blowers and is cooled as it passes over metal drums refrigerated by circulating water.

Preparing the plates used in offset lithography involves defining the joint presence of two mutually repellant materials, one water-receptive the nonprinting areas, and the other ink-receptive for the printing areas. The screen is necessary to translate the halftones of photographic illustrations into surface densities. Even though there is no question of creating reliefs, the preparation process is very similar to that of photoengraving. But, because the blanket intervenes between plate and paper, text and appear on the same offset plate in straight rather than in reverse reading as on letterpress plates.

Offset lithographic monometal plates are made of a metal with hydrophilic (water-receptive) properties, such as zinc or aluminum the surface of which is treated to make it more porous. The plate is coated with a thin layer of a photosensitive substance, covered with a negative of the texts and previously screened photographic illustrations and exposed to intense light. This hardens the photosensitive substance in the areas of the negative where the light passes through; that is, in those corresponding to the printing areas. The photosensitive is then washed away from the non-printing areas, where the metal, now stripped, is wetted; the hardened photosensitive substance is inked.

Deep-etch plates are monometal plates prepared by inversion. The plate coated with a photosensitive substance and then exposed to light through a positive of the text and screened photographic illustrations. This exposure hardens the photosensitive substance on the non-printing areas. Washing eliminates the photosensitive substance on the printing areas, exposing the metal. The plate is then given a mild acid bath, which etches the metal of printing areas to a shallow depth. An ink-receptive lacquer is spread over the surface of the plate; that is, over the hardened photosensitive substance wherever it still survives, as well as over the etched-metal areas. The hardened photosensitive substance and the lacquer are both removed at the same time by dissolving and brushing, exposing the metal of the non-printing surfaces to be wetted. Lacquer remains in the cavities of the etched areas, ready to be inked.

Bimetal or trimetal plates are composed of two superimposed metals, one of which is hydrophilic (aluminum, stainless steel, chromium, nickel) and the other ink-receptive (copper, bronze). Whichever of the two covers the other in a microscopic film is partly eliminated by the photoengraving operation. In the case of a hydrophilic metal, photoengraving is carried out using positives of the text and illustrations. In the opposite case, negatives are used. Among the combinations used in various commercial plates are chromium on copper or nickel on bronze for use with positives and copper on stainless steel or copper on aluminum for use with negatives. The combination of two metals can, in certain plates, take the form of a double film deposited on a third metal (steel or zinc), which simply serves as a base.

Printing inks contain three components, the vehicle, the coloring ingredients, and the additives. The vehicle, responsible for transferring the coloring ingredients from the ink fountain to the typeform, can be either a vegetable base (linseed, rosin, or wood oils) which dries by penetration and oxidation and at the same time ensures fixation, or a solvent base derived from kerosene, in which case drying takes place by evaporation. The coloring ingredients come m several forms: pigments, which are fine, solid particles manufactured from chemicals, generally insoluble in water and only slightly soluble in solvents, agents made from chemicals but soluble both in water and in solvents; and lacquers obtained by fixing a coloring agent on powdered aluminum. The additives stabilize the mixture and give the ink additional desirable characteristics. The nature and proportions of the ingredients vary according to the printing process to be used and to the material to be printed.

Offset lithography uses greasy inks. For printing on sheetfed presses, thick greasy inks are used in which the vehicle is generally made of vegetable oil with the addition of hard natural or synthetic resins dispersed in mineral oils. Roll fed rotaries use fluid greasy inks in which the vehicle is made up of heavy mineral oils.

The color black is generally obtained from an organic pigment, carbon black, derived from the incomplete combustion of oils or of natural gas. Color pigments are made from chrome (yellow, green, and orange), molybdenum (orange), cadmium (red and yellow), and iron (blue). Inks for offset are more highly colored than those used in letterpress, because they must be transferred to the blanket before they reach the paper. Furthermore, the pigment must resist being picked up by the water from the dampening system.

Inks with various special qualities exist for offset lithography. In high-gloss inks, the vehicle is not homogeneous, as with ordinary inks, but heterogeneous, based on synthetic resins dissolved in a solvent, with lead and cobalt additives. This ink glazes as it dries. When printing several colors, the whole series of operations must be finished before the ink has time to dry so that the inks can attach themselves to the surface. Quick-setting inks utilize a vehicle that also has a base of resins dissolved in a quick-drying solvent. Heat-set inks require the application of heat to facilitate both the oxidation process and the evaporation of the solvent, as well as the penetration of certain elements had rendered the ink more fluid. Cold-set inks are hardened by chilling after printing, having been kept fluid by heat until they were applied to the typeform. Moisture-set inks dry when moistened, either by the paper or by being sprayed with water. In these inks, the vehicle is a solvent, soluble in water, that, on contact, penetrates the paper, leaving the pigment on its surface.

Among other special-characteristic inks are metallic inks containing powdered copper, bronze, aluminum, or gold mixed with the pigment; inks, containing a powdered magnetized iron mixed with the pigment "recognizing" the shape of printed characters as they pass before electronic reading equipment; and fluorescent inks.

EXAMPLE

The present invention is further illustrated by the following example which is not intended to limit the effective scope of the claims.

A metallic finish was produced on a paper substrate employing the method of the present invention. An offset lithographic press, 55" Planeta offset press with UV drying, was used having a printing plate with a hydrophobic printing area and a hydrophobic non-printing area, a plate cylinder on which the printing plate is mounted, hydrophobic dampening rollers, hydrophobic ink rollers, a blanket cylinder, and an impression cylinder. The paper, solid bleached sulfate, was coated with three coats of ink applied successively, on one pass through a multicolor press, as follows to produce a metallic finish on the paper substrate: (1) a first coat comprising a gray solid color; (2) a second coat comprising a gray moire pattern color; and (3) a third coat comprising water pearl. The color of each coat of ink, the combination of the second moire pattern coat over the first solid coat, and the combination of the three coats of ink applied successively are set out in FIGS. 1 and 2.

Figure 1B:
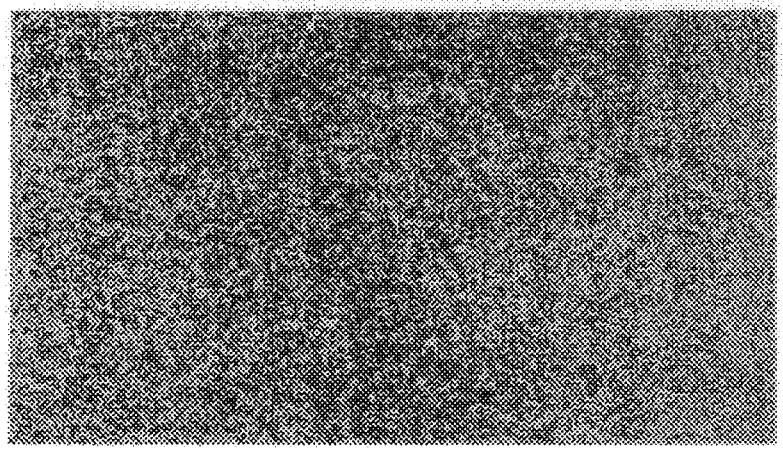
Figure 1C:
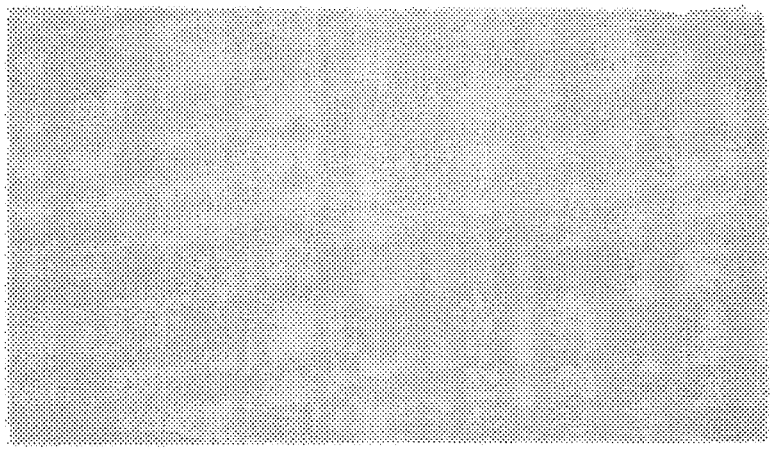

FIG. 1 is a photograph of three coats of ink applied successively to the printing substrate. Top panel shows a first coat comprising a gray solid color corresponding to the final color of the desired printing substrate. Middle panel shows a second coat comprising a gray moire pattern color. Bottom panel shows a third coat comprising water pearl.

Figure 2A:
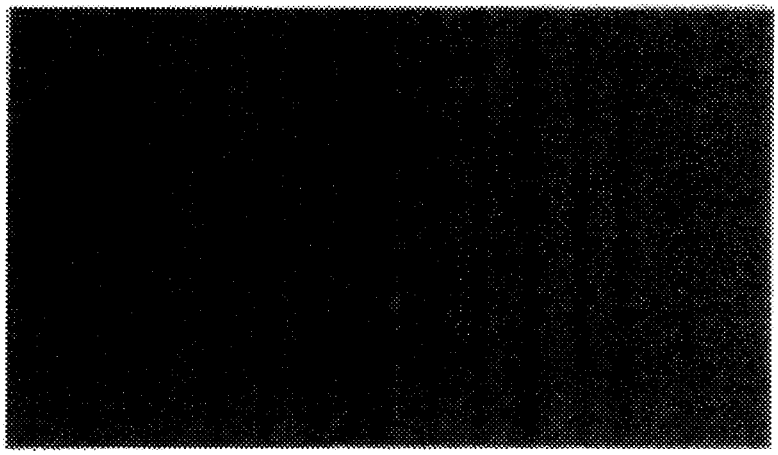
FIG. 2 is a photograph of combinations of coats of ink applied successively to a printing substrate. Panel A shows the combination of the second gray moire pattern coat over the first gray solid coat. Panel B shows the combination of the three coats of ink applied successively to a printing substrate in accord with the method of the present invention for producing a metallic finish.
Figure 2B:
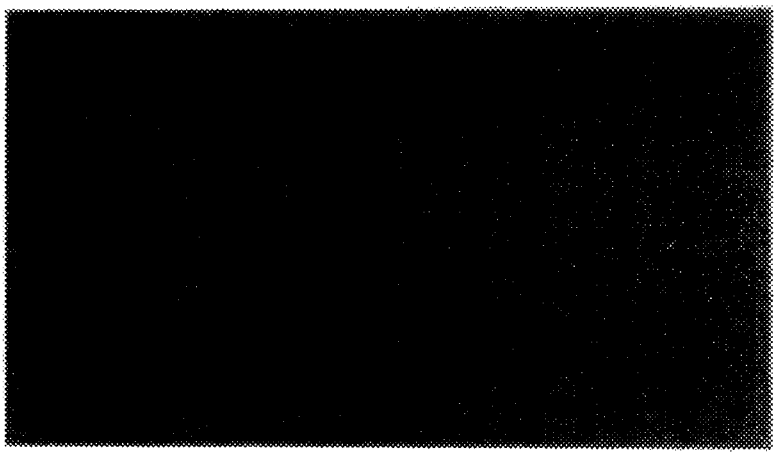

FIG. 2 is a photograph of combinations of coats of ink applied successively to the printing substrate. Top panel shows the combination of the second moire pattern coat over the first solid coat. Bottom panel shows the combination of the three coats of ink applied successively to a printing substrate in accord with the invention for producing a metallic finish.

The invention being thus described, it will be obvious that the same may varied in many ways. Such variations are not to be regarded as a departure from the spirit and scope of the invention and all such modifications are to be included within the scope of the following claims.

I claim:

1. A method for producing a metallic finish on a printing substrate which comprises the steps of coating the printing substrate with three coats of ink applied successively as follows to produce a metallic finish on the printing substrate:

(1) a first coat of ink comprising a solid color corresponding to the final color of the desired printing substrate;

(2) a second coat of ink comprising a moire pattern color over the first coat of ink; and (3) a third coat of ink comprising water pearl over the second coat of ink.

2. The method according to claim 1, wherein the moire pattern color is the color of the final desired printing substrate.

3. The method according to claim 1, wherein the three coats of ink are applied in one pass through a multi-color press.

4. The method according to claim 1, wherein the first solid color coat and the second moire pattern coat are gray.

5. The printed substrate having a metallic finish comprising a first coat, a second coat, and a third coat of ink wherein the first coat on the printed substrate comprises a solid color corresponding to the final color of the printed substrate, the second coat, which is over the first coat, comprises a moire pattern color, and the third coat, which is over the second coat, comprises water pearl.

6. The substrate according to claim 5, wherein the moire pattern color is the color of the final desired printed substrate.

7. The substrate according to claim 5, wherein the first solid color coat and the second moire pattern coat are gray.

8. A method for producing a metallic finish on a printing substrate using an offset lithographic press which comprises the steps of:

(a) providing an offset lithographic press having a printing plate with a hydrophobic printing area and a hydrophilic non-printing area, a plate cylinder on which the printing plate is mounted, hydrophilic dampening rollers, hydrophobic ink rollers, a blanket cylinder, and an impression cylinder;

(b) rotating the plate cylinder so that the plate cylinder first comes into contact with the hydrophilic dampening rollers permitting water from the hydrophilic dampening rollers to wet the hydrophilic non-printing area of the printing plate and preventing ink from the hydrophobic ink rollers to wet the hydrophilic non-printing area;

(c) rotating the plate cylinder so that the plate cylinder second comes into contact with the hydrophobic ink rollers permitting ink from the hydrophobic ink rollers to wet the hydrophobic printing area of the printing plate;

(d) transferring the hydrophobic printing area from the printing plate to the blanket cylinder; and (e) passing a printing substrate between the blanket cylinder and the impression cylinder to transfer the wet hydrophobic printing area from the blanket cylinder to the printing substrate;

wherein the printing substrate is coated with three coats of ink applied successively as follows to produce a metallic finish on the printing substrate:

(1) a first coat of ink comprising a solid color corresponding to the final color of the desired printing substrate;

(2) a second coat of ink comprising a moire pattern color over the first coat of ink; and (3) a third coat of ink comprising water pearl over the second coat of ink.

9. The method according to claim 8, wherein the moire pattern color is color of the final desired printing substrate.

10. The method according to claim 8, wherein the three coats of ink are applied in one pass through a multi-color press.

11. The method according to claim 8, wherein the first solid color coat and the second moire pattern coat are gray.

12. A printed substrate having a metallic finish prepared by a method using an offset lithographic press which comprises the steps of:

(a) providing an offset lithographic press having a printing plate with a hydrophobic printing area and a hydrophilic, non-printing area, a plate on which the printing plate is mounted, hydrophilic dampening rollers, hydrophobic ink rollers, a blanket cylinder, and an impression cylinder;

(b) rotating the plate cylinder so that the plate cylinder first comes into contact the hydrophilic dampening rollers permitting water from the hydrophilic dampening rollers to wet the hydrophilic non-printing area of the printing plate and preventing ink from the hydrophobic ink rollers to wet the hydrophilic non-printing area;

(c) rotating the plate cylinder so that the plate cylinder second comes into contact the hydrophobic ink rollers permitting ink from the hydrophobic ink rollers to wet the hydrophobic printing area of the printing plate;

(d) transferring the wet hydrophobic printing area from the printing plate to the cylinder; and (e) passing a printing substrate between the blanket cylinder and the impression to transfer the wet hydrophobic printing area from the blanket cylinder to printing substrate;

wherein the printing substrate is coated with three coats of ink applied successively as follows to produce a metallic finish on the printing substrate:

(1) a first of coat ink comprising a solid color corresponding to the final color of the desired printing substrate;

(2) a second coat of ink comprising a moire pattern color over the first coat of ink; and (3) a third coat of ink comprising water pearl over the second coat of ink.

13. The substrate according to claim 12, wherein the moire pattern is the color of the final desired printing substrate.

14. The substrate according to claim 12, wherein the three coats of ink are applied in one pass through a multi-color press.

15. The substrate according to claim 12, wherein the first solid color coat and the second moire pattern coat are gray.

* * * * *